United States Patent [19]

Karlsson

[11] 4,266,387

[45] May 12, 1981

[54] CONSTRUCTIONAL MEMBER FOR BUILDINGS

[76] Inventor: Jon Karlsson, Götalandsvägen 194, S-125 55 Älvsjö, Sweden

[21] Appl. No.: 23,195

[22] PCT Filed: Mar. 13, 1979

[86] PCT No.: PCT/SE78/00017

§ 371 Date: Mar. 19, 1979

§ 102(e) Date: Mar. 13, 1979

[87] PCT Pub. No.: WO79/00047

PCT Pub. Date: Feb. 8, 1979

[30] Foreign Application Priority Data

Jul. 19, 1977 [SE] Sweden ..... 7708343

[51] Int. Cl.[3] ..... E04B 2/62; E06B 1/12

[52] U.S. Cl. ..... 52/731; 52/211; 52/241; 52/739

[58] Field of Search ..... 52/241, 481, 738, 739, 52/476, 731, 211

[56] References Cited

U.S. PATENT DOCUMENTS 3,140,763 7/1964 Edelstein ..... 52/476

3,875,706 4/1975 Okawa ..... 52/398

FOREIGN PATENT DOCUMENTS 2329099 12/1974 Fed. Rep. of Germany ..... 52/238

*Primary Examiner*—John E. Murtagh

*Attorney, Agent, or Firm*—Oblon, Fisher, Spivak, McClelland & Maier

[57] ABSTRACT

The constructional member is intended for use in installations of falce ceilings, walls, doors and windows in buildings, and is formed as a substantially U-shaped rail with a web portion (1) and two leg portions (2, 3). Since one leg portion (3) is shapable onto the web portion (1), the rail can be first placed round the member (15) which is to be erected, e.g. a partition wall, and thereafter the constructional member can be fixed in place with the help of the snap-on leg portion (3). The middle portion (5, 7, 8) of the web portion (1) has channels which enable exact fitting of the constructional member either round a building member (17) or against another constructional member, e.g. at corners or edge surfaces. The member can be fixed against the ceiling and floor at an optional location in a room, which substantially simplifies installations and alterations. Further advantages are that all installations can be carried out as pure erection work and that the material which is used in an installation can be recovered and reused on being dismantling.

6 Claims, 16 Drawing Figures

CONSTRUCTIONAL MEMBER FOR BUILDINGS

Figure 1:
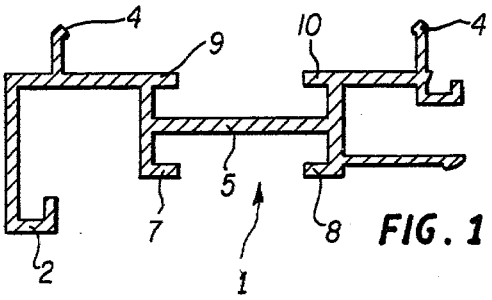

The present invention relates to a constructional member for buildings, preferably for use with pre-fabricated building members for false ceiling, wall, door, window and similar installations.

In building technology and especially with interior decoration fittings and fixtures, the different work operations must be very carefully planned today, so that the tradesmen who are to carry out the installation work on site will be of the right category for the work operation, and will be there at the right time as well. The situation becomes especially complicated for installations where tradesmen of different categories must return to the site repeatedly so as to allow other artisans to complete the parts of the building work which are a prerequisite for the next stage in the installation work. For example, electricians and plumbers must return to the site at different stages to put in wiring and pipes according as the installation of partition walls and false ceilings is completed. Such time and work planning is extremely difficult to execute, and in practice there are always collisions between tradesmen of different categories, who then interrupt each other's work. Artisans in one category sometimes cannot start their work due to the fact that a previous building stage is not ready. In other cases tradesmen in a certain category may perhaps have omitted to make additions to their work that are required to complete a definite building stage, which means that work already finished must be pulled down and done again. Planning building work under these conditions must obviously be extremely difficult, thus taking a lot of time as well as being expensive, not to mention how expensive incorrect planning must be for the owner of the building. In calculating building costs, one must always count on the occurrence of cost increases of this kind, and therefore these costs are also included in tenders to the purchaser.

Today, there are certain electrical systems which can be installed after most of the structural work has been completed, and these systems can also allow considerable flexibility with respect to placing electric light fittings, plug points and other arrangements pertinent to the electrical installation. Such systems are built up on a relatively simple basic installation, which must be put in at an early stage in building. The advantages of these known systems are naturally that in the planning stage it is not necessary to state in detail where power points and lighting fittings shall be placed, and they also enable wide rearrangements of these units if it is desired to use the premises for other purposes than those for which they were originally intended. These known electrical systems are based on standardized rails which can be placed in ceilings or on hangers, and which serve as cable channels in the ceiling. Both mains supply and light current cables can be placed in these rails, and the bottoms of the rails are formed with attachments for lighting fittings, thus enabling a flexible lighting installation. The ceiling system can also be supplemented with lines to tables directly from each rail, and such lines can then be supplemented in an optional way with earthed power points and telephone jacks. These known rail systems are furthermore designed as carriers for false ceilings, and the rails are then arranged in the form of a grid, the dimensions of which are suited to the ceiling module and lighting fitting length.

Prefabricated building slabs consisting of a compressed fibrous material, of the mineral wool type, on which there has been placed a hard surface material, e.g. of the heavily compressed glass fibre sheet type, are already known. These building slabs have extremely good heat and sound insulating properties, and the hard surface material is available in a number of different colours and patterns. If so required, the surface can be covered with woven or patterned wallpaper during manufacture of the slab.

The constructional member according to the present invention is intended for use together with prefabricated building members of the type mentioned above. The installation of partition walls, doors and false ceilings is thus simplified, so that this work can be carried out as a pure erection job, using prefabricated building members and utilizing the inventive constructional member. The building members as well as the constructional members arrive on site in a finished condition, for putting together with bolted joints. This means that the entire installation of interior fixtures can be carried out by one single category of artisans, who do not need to be trained in joinery or bricklaying, since such work does not need to be involved.

The inventive constructional member can also be used to advantage in conjunction with the electrical system described above, the electrical system thus being simplified to a great degree, and the installation of false ceilings and partition walls can be coordinated with that of laying electrical cables from the ceiling rails at the rate at which erection work is carried out.

These objects are substantially realized in that a substantially U-shaped basic rail comprises a basic web portion and two basic leg portions, the middle portion of the basic web being formed with supporting and anchoring means for connecting building members, and that at least one basic leg portion is removably attached to the basic web portion.

With the inventive constructionl member, substantial advantages are obtained in the form of shortened planning time, as well as very much simplified building construction in essentially two stages. The first stage consists of the finished building structure, i.e. all concrete work has been done and the main structures of the building are ready. In general it is then possible for concrete workers and carpenters to leave the site, and the installation of false ceilings, partition walls, interior decorating fittings and fixtures, electrical installation etc. is begun. During this latter stage, the whole installation can be carried out using building members and the inventive constructional member and, as already mentioned, the work can be carried out by a single categroy of tradesmen trained in electrical installation and erection.

Apart from the above-mentioned advantages obtained with the inventive constructional member, a flexible interior is also achieved, which can be easily altered and suited to individual requirements.

Since interior work can be mainly carried out by a single catgeory of tradesmen, planning work is also facilitated, and good coaction between different environmental components such as light, air and sound can be obtained at the site as early as the planning stage. The supply and erection of all interior building members such as false ceilings, partition walls, screens and lighting fittings can be carried out by the same supplier, who also answers for the erection work.

Since the entire interior installation is built up from prefabricated members, dismantling will naturally also be simplified and both walls and ceiling members can be re-used.

Figure 2:
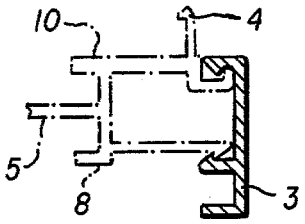
Figure 3:
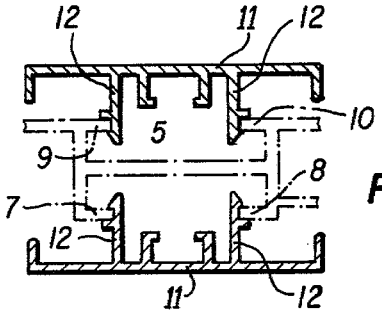
Figure 4:
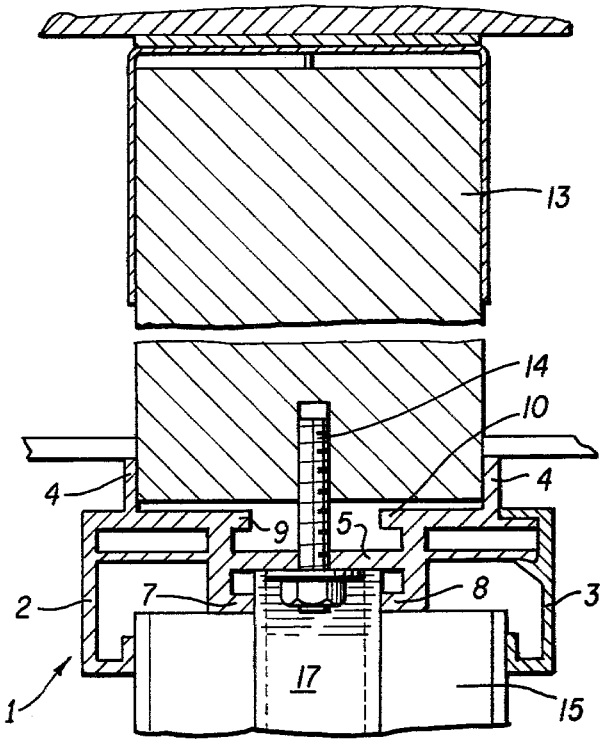
Figure 5:
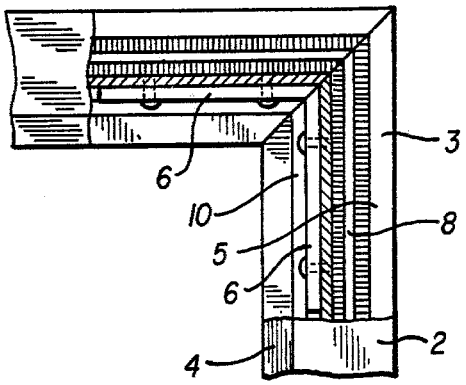
Figure 6:
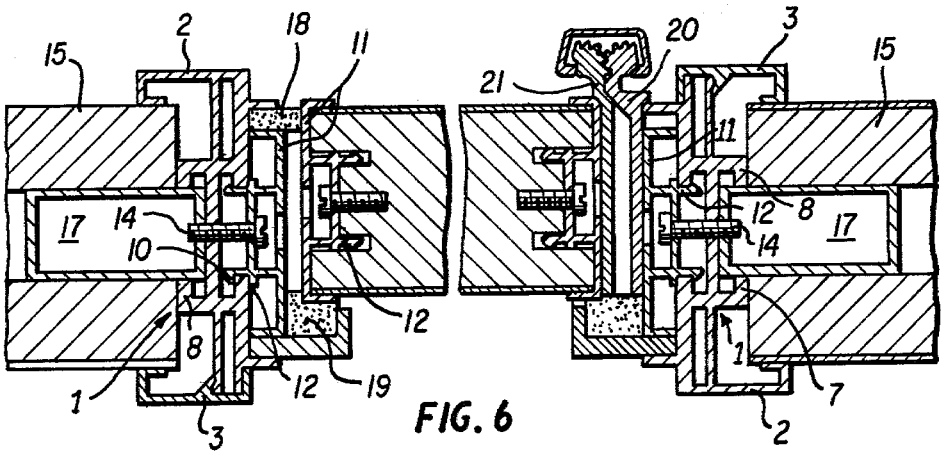
Figure 7:
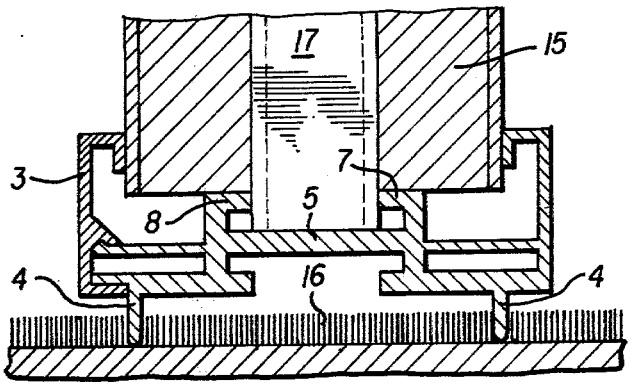
Figure 8:
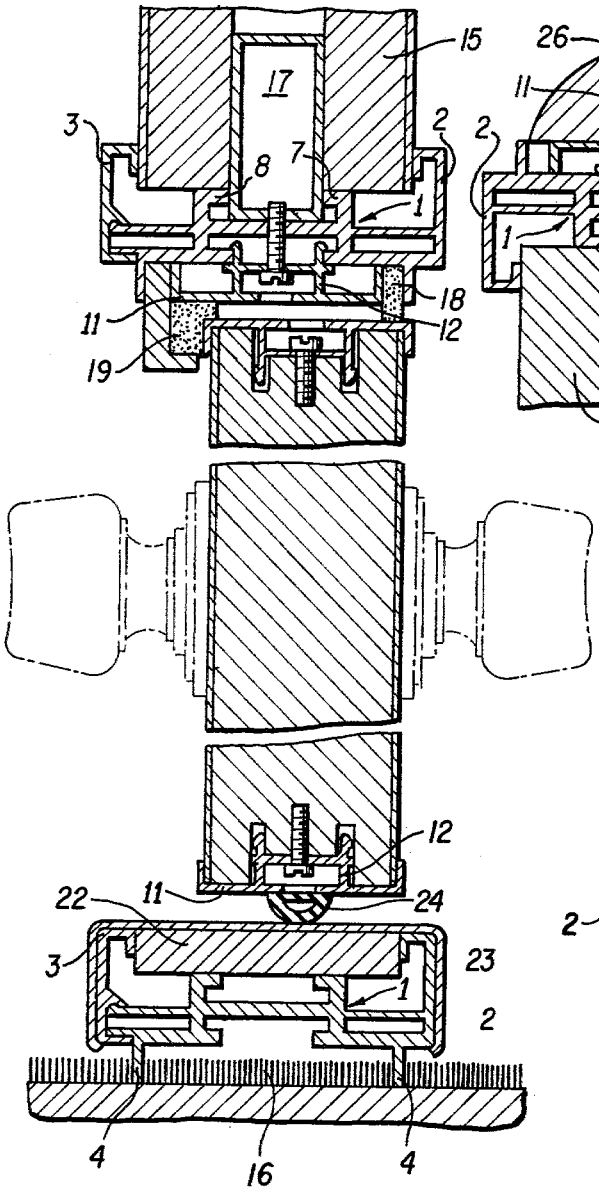
Figure 9:
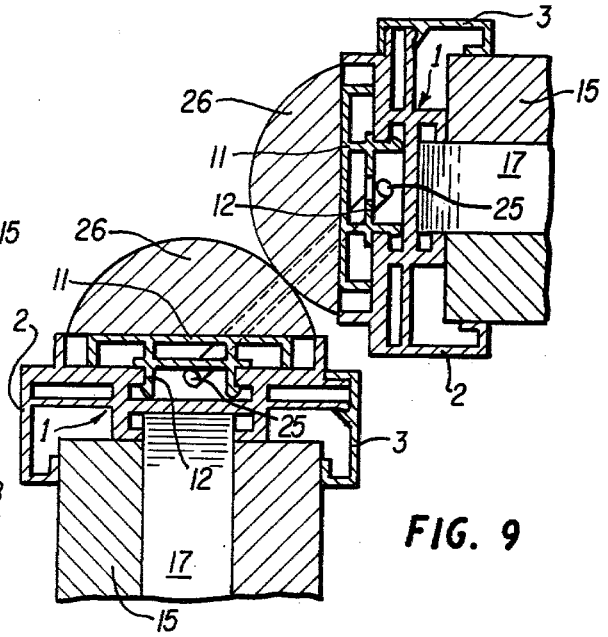
Figure 10:
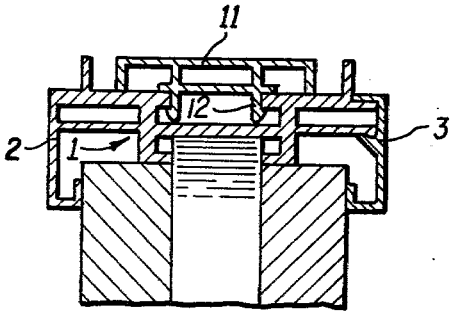
Figure 11:
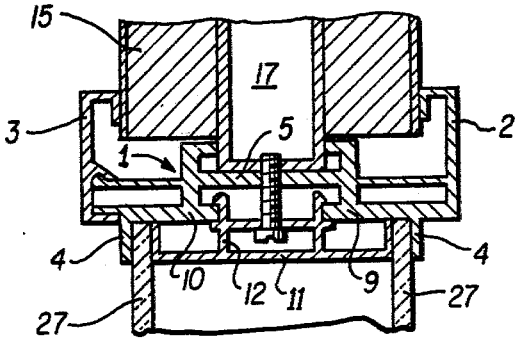
Figure 12:
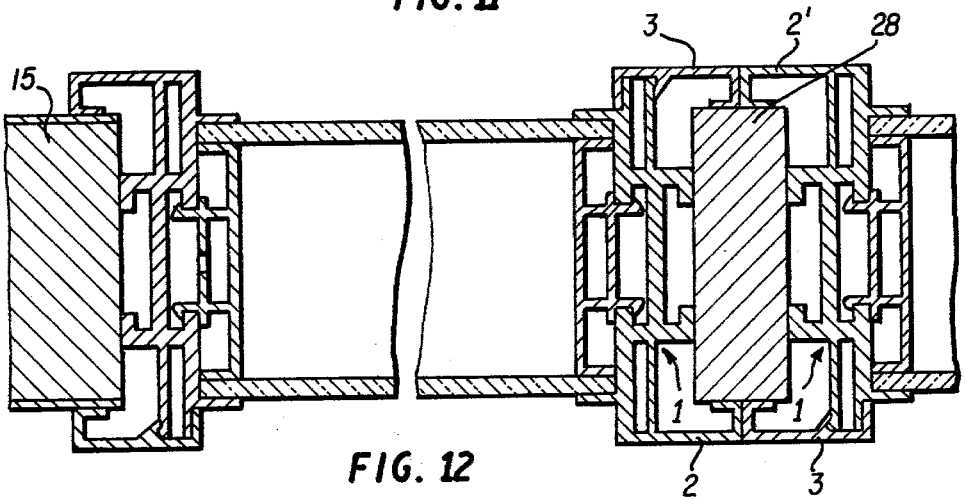
Figure 13:
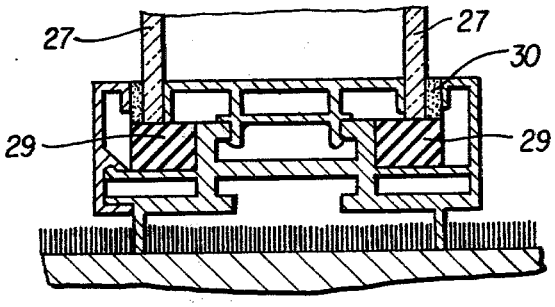
Figure 14:
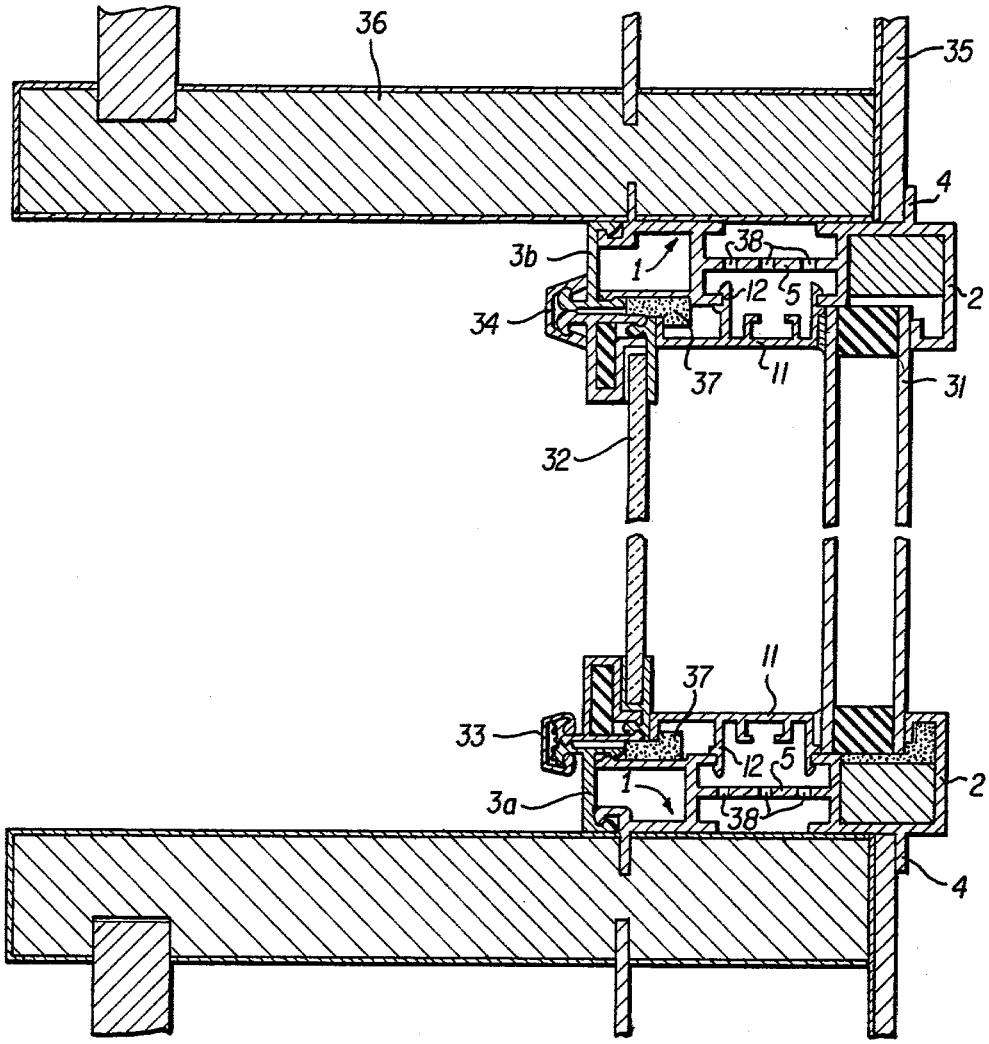
Figure 15:
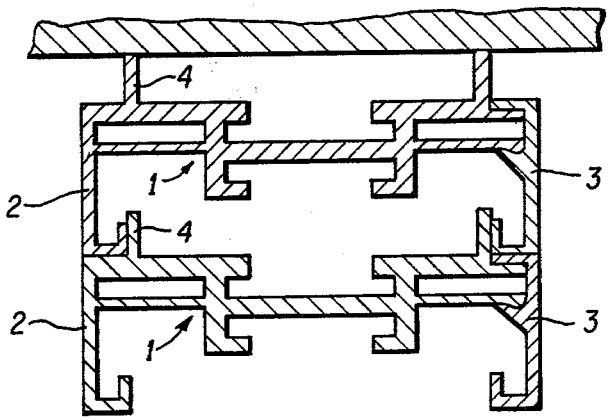
Figure 16:
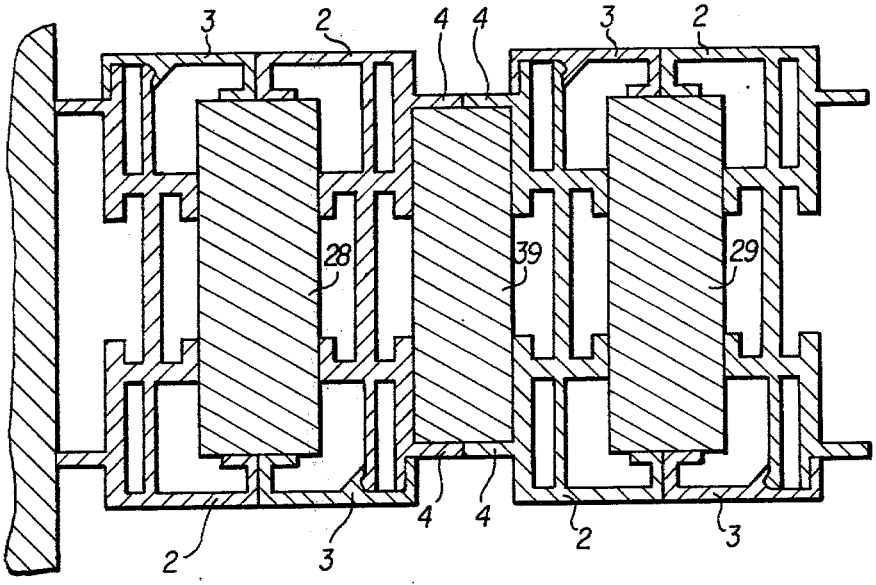

Some embodiments of the inventive constructional member, selected as examples to demonstrate its use, are described in detail below while referring to the accompanying drawings on which FIG. 1 is a cross section of a basic rail according to the invention, FIG. 2 is a cross section of a leg portion which is removably connected to the basic web portion, FIG. 3 is a cross section of two additional rails attached to a basic web portion according to FIG. 1, FIG. 4 is a cross section through a partition wall with a basic web portion arranged as ceiling support for the wall, FIG. 5 is a longitudinal section through a corner portion of a door frame according to FIG. 6, FIG. 6 is a horizontal section through a partition wall with a door frame and door leaf built up from the inventive constructional member, FIG. 7 is a cross section through the connection to the floor of the partition wall in FIG. 4, FIG. 8 is a cross section through the partition wall and door in FIG. 6, FIG. 9 is a cross section through a screen wall built using the inventive constructional member, FIG. 10 is the upper side of the screen wall in FIG. 9, FIG. 11 is a cross section through a ceiling connection for a glass wall, where the glazing is fixed by means of an inventive constructional member, FIG. 12 is a horizontal section through the glass wall, including pillars made up from the constructional member, FIG. 13 is a cross x section through the floor connection of the glass wall in FIG. 12, FIG. 14 is a horizontal section through a window structure built up from the inventive constructional member, containing insulating glazing and ordinary window glazing with window frames and sealings, FIG. 15 is a beam built up from the inventive constructional element and FIG. 16 shows an alternative beam structure.

FIGS. 1 and 2 show the parts, which together form a basic rail according to the invention. The rail thus comprises a basic web portion 1 and two basic leg portions 2 and 3, one part of the basic web portion being formed as an attachment for the basic leg portion 3, which is thus movably attached to the basic web portion 1. The basic rail is further formed with supporting legs 4 and anchoring means in the form of a substantially I-shaped section with a web portion 5 and flanges 7, 8, 9 and 10. Together with the basic web portion 1 the legs 2 and 3 define a first channel in which a building member, e.g. a wall slab, is introduceable with a suitable fit, as is apparent from FIGS. 4 to 14. With the anchoring web portion 5, the anchoring flanges 7, 8 and 9, 10 form two channels, one on either side of the rail, into which attaching members are fixable. One type of attaching member is shown in FIG. 3, and consists of a supplementary rail 11 provided with resilient means 12 for engagement with the ends of the anchoring flanges 7, 8 or 9, 10.

As is apparent from FIG. 4, the insides of the support legs 4 and the basic web portion 1 form a third channel, in which a building element such as a wall slab 13 can be introduced with a suitable fit. The basic rail 1, 2, 3 is attached to the wall slab 13 by means of a screwed connection 14, and the first channel, i.e. the one formed by the basic web portion 1 and the basic leg portions 2 and 3 accomodate another wall slab 15, constituting the ceiling connection for a partition wall. The floor connection is apparent from FIG. 7, where the support legs 4 are facing towards the floor and are fixed sideways by means of wall-to-wall carpeting or a similar soft floor covering, while the first channel accomodates the lower part of the wall slab 15. In the centre of the wall slab there is another tubular attaching member 17, fitting into the second channel formed by the anchoring web portion 5 and the anchoring flanges 7 and 8. This attachment member is formed as a tube, preferably from metal, which locks the wall structure sideways simultaneously as it constitutes a stiffening element in the wall. The cross section of the attachment member 17 can be seen in FIG. 6.

The horizontal section through the position wall and door in FIG. 6 illustrates the door frames, consisting of basic rails 1, 2, 3, fixed to their respective wall slabs 15 by means of screwed connections 14 in the member 17. As is apparent from the figures, there is a supplementary rail 11, 12 fixed into the second channel of the basic rail 1, 2, 3, while the attachment member 17 is inserted in the other second channel facing the opposite direction. The ends of the legs of the supplementary rail position the sealing elements 18 and 19, lying in the third channel of the basic rail with a pinching effect. The opposite side of the door frame is put together in a similar way, excepting that the supplementary rail 11, 12 constitutes the attachment for one part (20) of a hinge, the other part (21) of which is attached to the door leaf. The edge finishing of the door leaf consists of the same supplementary rail, which simplifies to a great degree the assortment of rails which must be kept in stock for use in different installations. The tubular attachment members 17 also serve as channels for electric cables, laid in a ceiling rail (not shown). Fitting power points is thus done by drilling a hole at the desired place in the tubular member 17, and the cable drawn down from the ceiling rail can be taken out for connecting to the socket, which can then be screwed into place. FIG. 5 shows the joint between one side member and the upper member of the door frame, using an angle piece 6, which can be introduced into the partially closed duct formed by the anchoring web portion 5 and each of the anchoring flange pairs 7, 8 and 9, 10. The angle piece is fixed into the duct by means of screws which are screwed against the web portion 5, to lock the angle piece against the edges of either flange pair by clamping action.

From the cross section of the door of FIGS. 4, 6 and 7, shown in FIG. 8, it is apparent that threshold as well as upper door frame are built up in a similar way as the frame sides in the other figures. The attachment members 17 are thus arranged as a frame in the side members of the door frame and the upper member, and serve as attachment for the screws fixing the basic rails to the supplementary rails. The door threshold is thus fixed lengthwise and in height by means of the side members of the door frame, while transverselly it is fixed by the engagement of the support legs 4 against the substructure. In the channel between the leg portions 2, 3 and the web portion 1, there is a filler body 22, and the whole threshold is encased in a decorative and durable casing 23. The lower edge of the door is provided with a seal 24, attached in a simple manner to the lower supplementary rail 11, 12.

The screen wall shown in FIG. 9 is also built up from prefabricated wall slabs 15 and attachment members 17, fixed into a basic rail 1, 2, 3 according to the invention. The basic rail accomodates the pivoting mechanism 25 of the folding wall, and also the rounded portions 26 enabling effective sealing between the wall slabs, independent of the mutual attitude between them. FIG. 10 shows the upper side of the screen wall, which has been provided with a fitting consisting of the basic rail 1, 2, 3, to which a supplementary rail 11, 12 has been attached.

FIGS. 11–13 show an interesting application of the inventive constructional member. It is possible to utilize the basic rail for glass walls as well as window structures, where of course the wall structure is the simpler one in practice. FIG. 11 is a cross section through the connection of the glass wall to an upper wall portion, which as with previous structures, consists of a wall member 15 and attachment rail 17, each accomodated their respective channels on the basic rail 1, 2, 3. The second channel 9, 10, 5 receives a supplementary rail 11, 12 between the corners of which and the respective adjacent supporting leg 4 there is a sheet of glass 27. FIG. 12 shows the glass wall in plan, where the lefthand portion constitutes a connection to a side wall 15, while the righthand portion consists of a pillar, comprising two mutually facing basic rails 1, 2, 3, 1', 2', 3', which are fitted round a supporting body 28, e.g. a steel tube to give the structure its carrying capacity. FIG. 13 shows the floor connection of the glass wall, where the sheets of glass 27 rest against elastic support elements 29, and where possible gaps between the glass and the constructional member are shown filled with sealing material 30.

FIG. 14 is a cross section through a window formed triple with glazing, the two outer sheets of glass consisting of an insulation panel 30, rigidly mounted in the window frame, while the inner glazing sheet 32 is hinged. The window is mounted in a frame consisting of a basic web portion 1, a fixed leg portion 2 and a removable leg portion **3*a* or 3*b*, the latter two including a hinged portion 33 and a locking portion 34, respectively. One of the support legs 4 engages against the outside of the fazade, while the other is accommodated in a groove in the window wall 36. When the window is fitted, the cavities in the constructional members are suitable filled with a foam plastics material to improve insulation and prevent the occurrence of cold bridges through the frame members. The web portion is provided with holes 38 for further preventing the occurrence of cold bridges and to alow the foam material to come into all the cavities in the rail. The insulation panel 31 and the inner seals 32** are kept in place by means of supplementary rails, the width of which are adjustable to suit the members positioned by means of clamping action against the leg portions of the basic rail.

In FIG. 15 will be seen the principle for a beam structure in which two basic rails are fitted to each other to form a beam section. In this case the surfaces facing each other of the basic supporting legs 4 form a U-section together with the basic web portion 1, this U-section fitting the first channel on another basic rail. FIG. 16 shows an alternative beam structure where the basic rails are attached to a support body 28 arranged in the first channels of two basic rails, the leg portions 2 and 3 of which are facing each other. Another support body 39 is arranged in the third channel to one of the two basic rails and the third channel of a further basic rail, the support legs 4 of both last-mentioned basic rails facing towards each other. Using this assembly pattern, an entire wall can be built up using the inventive constructional member.

I claim:

1. A constructional member for use with prefabricated building elements used in ceiling, wall, door, and window installations, comprising a base rail with a substantially U-shaped cross section having a web portion and two leg portions of resilient material, one of said leg portions being releasingly attached to one end of the web portion by means of resilient engagement between latching members arranged on these portions, wherein the base rail is provided with two supporting limbs opposingly directed in relation to the leg portions, the outer distance between the supporting limbs corresponding to the inner distance between the leg portions, so that the base rails can fit into each other, and in that the central part of the web portion is formed with two U-shaped attachment rails with a common web portion and opposingly directed shank pairs which together with the attachment web portion define similar channels, in which building members and/or clamping elements of the constructional member is insertable; including a fastening element associated with the constructional member and consisting of a clamping rail which is U-shaped in cross section and provided with a web portion and two shanks, the height of which from the outer surface of the web portion facing away from the shanks substantially corresponds to the height of the supporting limbs of the base web portion and that the web portion of the clamping rail is also formed with two gripping elements which are at the ends provided with hooks and intended for engagement with the shank ends of the attachment rails.

2. A member as claimed in claim 1, characterized in that the U-shaped clamping rail is mirror symmetrical about a symmetry plane in the length of the rail and through the centre of the web portion.

3. A member as claimed in claims 1 or 2, characterized in that the clamping rail is so adapted in width that in its fixation in any of the attachment rails gaps are formed between the shanks of the clamping rail and opposing portions of the base rail, said portions either consisting of the supporting limbs or the leg portions, whereby building elements of different kinds are fixable by clamping action in said gaps, and that the width of the clamping rail is adjustable to the building details intended for fixing in the gaps.

4. A constructional member for use with prefabricated building elements used in ceiling, wall, door and window installations, comprising a base rail with a substantially U-shaped cross section having a web portion and two leg portions of resilient material, one of said leg portions being releasingly attached to one end of the web portion by means of resilient engagement between latching members arranged on these portions, wherein the base rail is provided with two supporting limbs opposingly directed in relation to the leg portions, the outer distance between the supporting limbs corresponding to the inner distance between the leg portions, so that the base rails can fit into each other, and in that the central part of the web portion is formed with attaching means including two U-shaped attachment rails with a common web portion and inwardly directed opposingly directed shank pairs which together with the attachment web portion define similar channels, the openings of said channels being reduced in width by said shank pairs, in which building members and/or clamping elements of the constructional member are insertable for attachment by the attaching means.

5. A member as claimed in claim 4, characterized in that the base rail, with the exception of the engaging latching members coacting with one of the leg portions, is formed substantially mirror symmetrical about a symmetry plane in the longitudinal direction of the rail.

6. A member as claimed in claim 4, characterized in that the releasingly attachable leg portion on its outer surface facing away from the other leg portion is provided with means for engagement with the rail.

* * * * *

UNITED STATES PATENT AND TRADEMARK OFFICE

CERTIFICATE OF CORRECTION

PATENT NO. : 4,266,387

DATED : May 12, 1981

INVENTOR(S) : JON KARLSSON

It is certified that error appears in the above—identified patent and that said Letters Patent is hereby corrected as shown below:

On the title page correct the PCT Filing Data to read as follows:

[22]-- PCT Filed: July 11, 1978 --rather than

[22]-- PCT Filed: Mar. 13, 1979 --as it now appears.

Signed and Sealed this

*Fifth* Day of *October 1982*

[SEAL]

*Attest:*

GERALD J. MOSSINGHOFF

*Attesting Officer* *Commissioner of Patents and Trademarks*